US005337490A

United States Patent [19]

Griffin et al.

[11] Patent Number: 5,337,490

[45] Date of Patent: Aug. 16, 1994

[54] SINGLE TIER DRYER THREADING NOZZLE FOR PAPER MACHINES

[75] Inventors: Edward R. Griffin, Quinnesec; Wesley R. Urban, Iron Mountain; Arlen J. Hintsala, Republic, all of Mich.

[73] Assignee: Champion International Corporation, Stamford, Conn.

[21] Appl. No.: 78,821

[22] Filed: Jun. 21, 1993

[51] Int. Cl.[5] ..... F26B 5/04

[52] U.S. Cl. ..... 34/117; 34/115

[58] Field of Search ..... 34/23, 116, 117, 113, 34/115, 120; 162/193, 286, 194

[56] References Cited

U.S. PATENT DOCUMENTS

| | | | |
|---|---|---|---|
| 4,416,070 | 11/1983 | Vedenpa et al. | 34/114 |
| 4,835,881 | 6/1989 | Welsby | 34/117 |
| 4,918,836 | 4/1990 | Wedel | 34/23 |
| 4,996,782 | 3/1991 | Eivola | 34/114 |
| 5,062,216 | 11/1991 | Hannigan | 34/16 |

*Primary Examiner*—Henry A. Bennet

[57] ABSTRACT

A dual air threading nozzle apparatus is disclosed for threading a paper web through a single tier drying section of a paper making machine. The single tier drying section includes a dryer roll, a dryer felt and a vacuum transfer roll. The dual air threading nozzle apparatus emits two angular planes of airflow for urging the paper web in a first direction to prevent engagement with the doctor blade for the dryer roll and in a second direction to closely conform to the dryer felt as it traverses between each dryer roll and vacuum transfer roll.

11 Claims, 3 Drawing Sheets

SINGLE TIER DRYER THREADING NOZZLE FOR PAPER MACHINES

BACKGROUND OF THE INVENTION

This invention relates to a dual air nozzle apparatus for use in a single tier dryer section of a paper making machine. In particular, the present invention provides an improved apparatus for the threading of a paper web through a single tier dryer section of a paper making machine.

It is well known in the paper making art to use a single tier dryer section to dry a paper web which emerges from the paper press section of a paper making machine. An example of a single tier dryer section is disclosed in U.S. Pat. No. 5,062,216 entitled "SINGLE TIER MULTI-CYLINDER PAPER DRYER" which issued to Hannigan on Nov. 5, 1991, and is assigned to the assignee of the subject invention. The single tier dryer section disclosed in U.S. Pat. No. 5,062,216 includes a plurality of separate drying stages, with each separate stage including at least two steam dryers, and with a vacuum transfer roll interposed between adjacent dryers. Generally, a single tier dryer section includes a plurality of alternate top and bottom felted dryer stages which alternatively dry opposite sides of the web as the web progresses through the single tier dryer section.

In a single tier dryer arrangement there is provided a dryer felt which supports the paper web in each dryer stage. The dryer felt and paper web in each dryer stage extend continuously and alternatively around each dryer and vacuum transfer roll such that the dryer felt is disposed between the paper web and each vacuum transfer roll. A partial vacuum is applied to each vacuum roll as the web and dryer felt traverse around the vacuum roll, and the partial vacuum effectively urges and restrains the paper web into close conformity with the dryer felt. This restraint minimizes cross-directional shrinkage and improves the sheet quality and uniformity of the paper web.

As disclosed in U.S. Pat. No. 5,062,216, there may be provided adjacent to each dryer an air nozzle and, in designated instances, a radiant induction heater. The radiant heater may extend across the width of the web and the air nozzle associated with the heater blows hot air warmed by the heater against the web to provide for removal of moisture and water vapor from the paper web. The air nozzle performs an additional function by assisting in the threading process since the hot air blast is directed to blow the web against the felt as the felt leaves a dryer and moves towards the associated vacuum transfer roll. A doctor blade adjacent each dryer is also provided to scrape off any contaminants of the traversing paper web from the dryer roll surface. Failure to remove the contaminants from the dryer roll surface could have a detrimental effect on the quality of the product being produced. This arrangement, along with the vacuum transfer roll, eliminates the threading of the paper web by the use of ropes during the start-up process, thereby reducing maintenance.

The principal advantage presented by the single tier dryer section disclosed in U.S. Pat. No. 5,062,216 is that the open draw between dryers within each dryer stage is eliminated. Open draw is the passing of the paper web unsupported by the felt from one dryer stage to the next stage. Such passing of the paper web in open draw causes the web to be susceptible to folding, wrinkles and tears. Even though the aforementioned single tier dryer apparatus disclosed in U.S. Pat. No. 5,062,216 is an effective single tier dryer section for drying a web, an occasional problem exists in that the web tends to flutter when transferring between each dryer roll and its associated vacuum transfer roll. Such fluttering often leads to threading problems, and may also result in tearing of the web. More specifically, during the threading of the aforementioned single tier dryer section, the tail of the web tends to disassociate from the dryer rolls and wander in the cross-machine direction as it moves down the machine. In particular, the tail has the tendency to disassociate from the felt and subsequently engage the doctor blade or the threading air nozzles adjacent to each dryer roll thereby causing threading problems. Moreover, a substantial amount of paper web residue may accumulate on the air nozzles thereby minimizing the air flow and effectiveness of the air nozzles.

Thus, it is an object of the present invention to overcome the shortcomings of the prior art single tier dryer section for paper making machinery by providing a new and improved apparatus which achieves more effective automatic threading of a paper web through a single tier dryer section.

Another object of the present invention is to provide a new and improved apparatus for drying a paper web in which the paper web is controlled to remain in contact with the dryer felt as the paper web progresses from the dryer roll towards the vacuum roll.

A further object of the present invention is to provide a new and improved apparatus for drying a web of a paper in which the tail and subsequent paper web thereof are urged away from the doctor blade as the paper web progresses from the dryer roll towards the vacuum roll.

Still a further object of the present invention is to provide a new and improved apparatus which facilitates the threading of a paper web in a single tier dryer while being shielded from the build-up of paper web residue.

Yet another object of the present invention is to provide a new and improved apparatus for facilitating the threading of a paper web in a single tier dryer section which is economical and efficient to manufacture and operate.

SUMMARY OF THE INVENTION

The present invention relates to a multiple air threading nozzle apparatus for threading a paper web in a single tier drying section of a paper making machine. In particular, the present invention provides an apparatus for directing a first, generally planar flow of air and a second, generally planar flow of air toward a traversing paper web to simplify the threading of a single tier dryer section. The first flow of air functions to effectively direct the tail of the paper web away from a doctor blade and to closely conform to the dryer felt. The second flow of air functions to urge the paper web over the partial vacuum transfer roll.

In accordance with the present invention, a single tier drying section includes a plurality of separate stages throughout the single tier dryer section for drying the opposite sides of the paper web. Each stage includes an endless dryer felt, at least one dryer roll, and at least one vacuum transfer roll. A transfer means is provided to transfer the web between succeeding stages of the single tier dryer.

In each separate stage, the paper web is temporarily disposed on an endless dryer felt which follows a serpentine path through the single tier of dryer rolls and vacuum transfer rolls, with a vacuum transfer roll being interposed between each dryer roll. This arrangement ensures that each vacuum roll provides a positive web restraint by holding the web to the dryer felt as it transfers between dryers. A doctor blade is provided adjacent each dryer roll so as to scrape off any containments from the dryer roll surface. The dual air threading nozzle apparatus of the subject invention is disposed adjacent each dryer roll so as to ensure the proper threading of the web and thereby increase the overall efficiency of the single tier dryer. The subject dual air nozzle apparatus includes first and second air pipes, with each respective air pipe having a plurality of air nozzles, and with the air pipes being enclosed by a hemi-spherical housing or fairing in such manner that the plurality of air nozzles do not extend beyond the outer surface of the protective shell. The dual air nozzle apparatus provides a first flow of air and a second flow of air which are directed in two angular planes so as to effectively urge the traversing paper web to be directed away from the doctor blade and nozzles, and closely conform to the dryer felt in each stage of the single tier dryer.

After the dryer felt and web have passed a given number of dryers in each stage of the single tier dryer, the web is transferred to a succeeding separate stage. The transfer is effected by a vacuum transfer roll in such a manner that the side of the web previously in contact with the dryers of the prior stage are now in direct contact with the dryers of the succeeding stage which, in turn, serves to evenly dry both sides of the paper web. This procedure is repeated through all of the aforementioned separate stages in the single tier dryer which results in more uniform drying of the web.

DETAILED DESCRIPTION OF THE DRAWINGS

Figure 1:
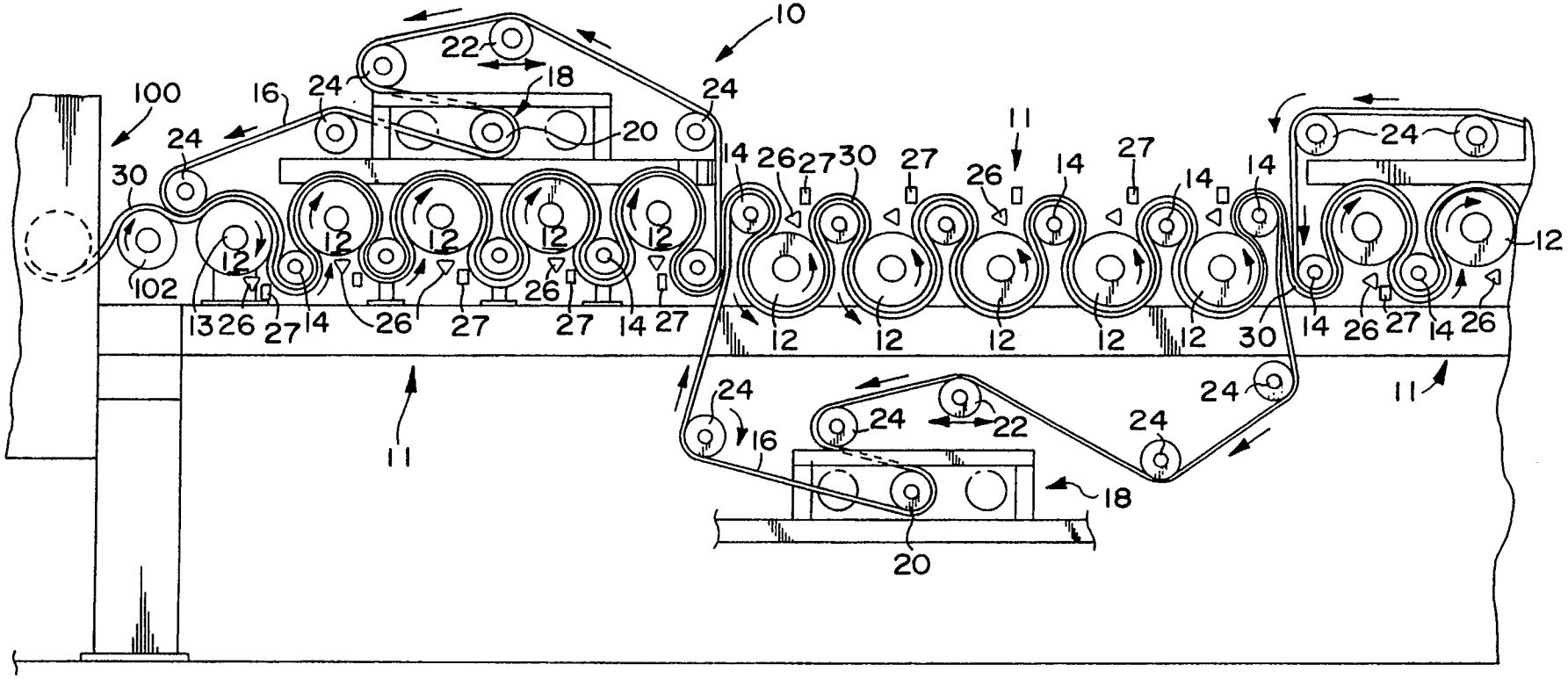
FIG. 1 (PRIOR ART)
FIG. 1 is a partial side elevational view of the first several stages of the prior art single tier dryer section for a paper making machine.

Referring to FIG. 1, wherein like numerals indicate like elements, a prior art single tier dryer section 10 in accordance with the teachings of U.S. Pat. No. 5,062,216 is designed to be stationed at the exit of a paper press apparatus 100. The prior art single tier dryer section 10 consists of a single tier of tandem, rotatable cylindrical dryers 12 extending from the dryer entrance at the exit of a press 100 to a dryer exit (not shown). The design of the single tier dryer section 10 is well-known in the prior art, and does not form part of the present invention. Generally, in the single tier dryer section 10 the rotatable cylindrical dryers 12 are journaled for rotation about their axes 13, and are provided with vents through which steam is emitted to dry a paper web 30 emerging from press 100. The single tier of rotatable cylindrical dryers 12 are subdivided into a plurality of separate stages, with each stage having approximately five rotatable cylindrical dryers 12, and with each stage being indicated by the numeral 11. The axes 13 of the first and subsequent odd stages of the rotatable cylindrical dryers 12 are offset higher in a vertical direction than the axes 13 of the second and subsequent even stages of the rotatable cylindrical dryers 12.

In the interstices between the rotatable cylindrical dryers 12 are vacuum transfer rolls 14. The axes of these vacuum rolls 14 are at approximately the lowest level of the circumference of rotatable cylindrical dryers 12 in the first and subsequent odd stages 11. Similarly, the axes of the vacuum rolls 14 are at approximately the highest level of the circumference of the rotatable cylindrical dryers 12 in the second and subsequent even stages 11. At the interfaces between each of the stages 11 of the rotatable cylindrical dryers 12 are two vacuum rolls 14, one at the level corresponding to the odd stage of rotatable cylindrical dryers 12, and another at the level of corresponding to the even stage of rotatable cylindrical dryers 12. Vacuum is drawn in rolls 14 in the conventional manner well-known in the art. Each stage 11 of the single tier dryer 10 includes an endless dryer felt 16 which enters the side of each stage closer to the press 100 and travels a serpentine path around each of a succession of alternating rotatable cylindrical dryers 12 and vacuum transfer rolls 14. Upon exiting the side of the stage 11 away from the press 100, the felt 16 travels through a drive mechanism 18 which includes a dry roller 20, a tension roller 22, and idler rollers 24 before re-entering the side of the succeeding stage 11 closer to the press 100. As the rotatable cylindrical dryers 12 in each stage are journaled for rotation about their axes 13, they are driven by the endless dryer felt 16 in each stage 11 and rotate with a synchronized surface speed.

Adjacent to each dryer 12 is an air nozzle and in some instances a radiant induction heater 27. It is possible for each dryer to be provided with a radiant induction heater but this is not required or necessary. The radiant heater can extend across the width of the web and an air cap can blow hot air warmed by a heater against the web to provide for removal of moisture and water vapor from the sheet and provide for differential drying. The hot air blast also aids in blowing the web against the felt belt as the felt leaves a dryer and moves towards the vacuum transfer roll 14. The air nozzle also is instrumental in the threading process. A doctor blade 26 adjacent each dryer is also provided to scrape the web from the dryer to prevent wrapping of the dryer and to keep the dryer clean. It is noted that the single air nozzle arrangement as provided in the prior art single tiered multi-cylinder paper dryer section is not encased within a fairing for preventing possible snagging with the paper web as it progresses from the dryer roll to the vacuum transfer roll 14.

Figure 2:
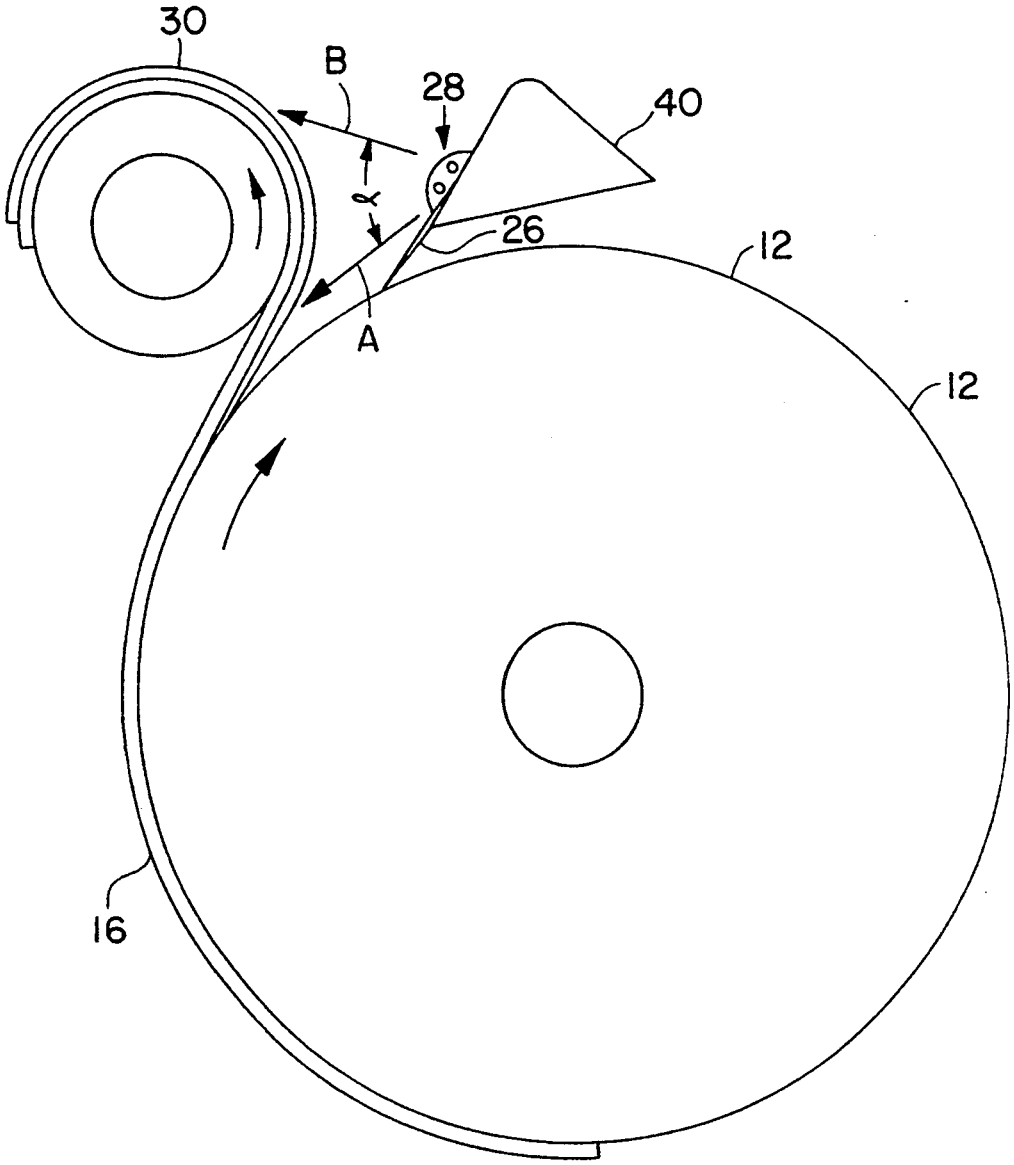
FIG. 2 is a side elevational view of the dual air nozzle apparatus of the subject invention and illustrating the threading of a paper web through a single tier dryer section.
Figure 3:
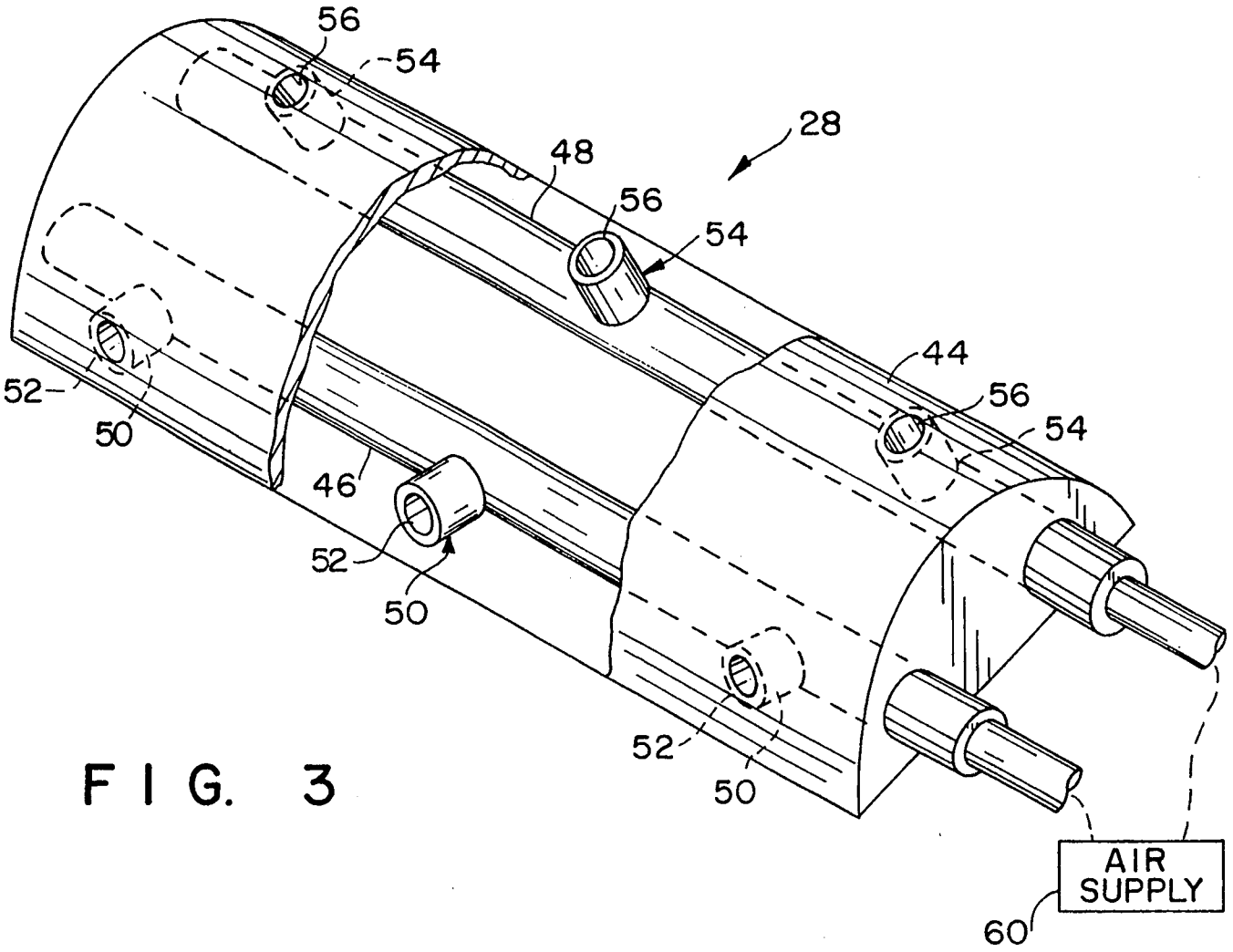
FIG. 3 is a perspective view, partly in section, of the dual air threading nozzle apparatus of the subject invention.

In order to obviate the potential problems associated with the prior art devices, the subject invention as shown in FIGS. 2 and 3 provides a dual air nozzle threading apparatus disposed within a fairing or protective shell, and operative to simultaneously urge the paper web away from the doctor blade and to direct the paper web in close conformity with the dryer felt as the paper web progresses from the dryer roll towards the vacuum roll. In addition, the fairing structure of the subject apparatus ensures that the paper web does not engage and become entangled with the distal ends of the nozzles.

Referring to FIGS. 2 and 3, a supporting beam 40 extends along and is disposed adjacent to each dryer roll 12, and supports doctor blade 26 and the dual air threading nozzle apparatus of the subject invention, generally designated by numeral 28. Each dual air threading nozzle apparatus 28 includes a hemi-spherical housing or fairing 44 which encloses two parallel air pipes 46 and 48. First air pipe 46 is provided with a spaced plurality of air nozzles 50, the distal ends 52 of which are flush with the outer surface of fairing 44. Similarly, the second air pipe 48 is provided with a plurality of spaced nozzles 54, the distal ends 56 of which are flush with the surface of the fairing 44. The air nozzles 54 of the air pipe 48 are disposed in a plane which is at an angle to the plane of the air nozzles 50 of the first air pipe 46. The first and second air pipes 46 and 48 are respectively connected to an air supply means 60 (shown schematically in FIG. 3) for providing a constant flow of air to the nozzles 50 and 54.

As more fully described below, the angular alignment of the nozzles 50 and 54 provide two distinct sheets of constant air flow from the fairing 44, which sheets of air flow are in two planes disposed angularly relative to each other. The plane of the sheet of air flow from nozzles 50 is designated by the arrow A in FIG. 2, while the plane of the sheet of air flow from nozzles 54 is designated by the arrow B. By this arrangement, the dual air threading nozzle apparatus 28 is operative to facilitate the automatic threading of a paper web 30 in a single tier dryer 10. Moreover, the dual air threading nozzle apparatus 28 is operative to prevent fluttering of paper web 30 as the paper web transgresses from each dryer roll 12 to its accompanying vacuum transfer roll 14. Additionally, the smooth outer surface and configuration of the hemi-spherical fairing 44 prevents the accumulation of paper web residue on the respective air nozzles 50 and 54.

In the operation of a single tier dryer as shown in FIG. 1, between adjacent stages of the rotatable cylindrical dryers 12, the dryer felt 16 of the adjacent stages 11 run in tandem, with their runs one above the other, to define a linear path between the vacuum rolls 14 at the exit and entrance of each respective stage. The paper web 30 to be dried is withdrawn from the paper press 100 over roller 102 and inserted between the dryer felt 16 and the first rotatable cylindrical dryer 12 of the first stage 11. As the web 30 and dryer felt 16 traverse the first rotatable cylindrical dryer 12, the web 30 is held tightly to the rotatable cylindrical dryer 12 by the dryer felt 16. As shown in FIG. 2, a constant plane A of a first flow of air is expelled from air nozzles 50 of apparatus 28 and is directed to force the tail and subsequent paper web 30 away from the doctor blade 26 and onto the dryer felt 16 during the threading stage. The doctor blade 26 is provided on each supporting beam 40 to clean the circumference of the dryer roll 12 by scraping away any paper web contaminants thereon caused by the traversing paper web 30. Accordingly, the first plane A of air is effective to prevent the paper web 30 from becoming engaged or entangled in the doctor blade 26, as well as preventing the paper web 30 from being contaminated with contaminants which have accumulated on the doctor blade 26. In addition, because of the smooth hemi-spherical configuration of the fairing 44 and the arrangement of the distal ends 52, 56 of the nozzles 50, 54 being flush with the external surface of the fairing 44, if the tail of the paper web 30 should flutter and engage the apparatus 28, there is little likelihood that the paper web would become entangled with the apparatus 28. Fluttering of the paper web 30 is also minimized by the angular relationship between the planes A and B of the airflow, and it is recommended that the angle "$\alpha$" between airflow planes A and B be approximately 80°, and preferably in the range of 45°-90°.

As the paper web 30 is urged away from the doctor blade by airflow A, the second plane of a constant flow of air B, which is at an angle "$\alpha$" to the airflow plane A, is expelled from air nozzles 54 of the apparatus 28 and urge the tail of the paper web 30 toward and over the vacuum roll 14.

As the tail of the paper web 30 passes each respective air threading nozzle apparatus 28, fluttering of the web is minimized and it is urged by the air flow to closely conform to the dryer felt 16. The web 30 and felt 16 then immediately transverse the periphery of the vacuum roll 14, with the felt 16 being disposed between the web 30 and the vacuum roll 14. The felt 16 and web 30 are then moved into contact with the circumference of the next rotatable dryer roll 12, with the paper web 30 being in contact with the cylindrical surface of the next dryer roll 12 and the process described above is repeated as the felt 16 and web 30 transverse approximately five rotatable cylindrical dryers 12 for each respective dryer stage 11.

After the dryer felt 16 and web 30 have traversed all of the rotatable cylindrical dryers 12 of a drying stage 11, the web 30 is sandwiched between the opposed runs of felts 16 of two successive drying stages 11. A vacuum transfer roll 14 at the entrance to the next stage is used to transfer the web 30 from one dryer felt 16 to the dryer felt 16 in the next stage, reversing the orientation of the web 30, thereby assuring that both sides of the web are equally dried by contact with the dryers 12 in successive stages. Each respective dryer 12 in each stage 11 is provided with the dual air threading nozzle apparatus 28 of the subject invention to simplify the threading and subsequent passing of a paper web 30 through a single tier dryer section 10.

While the invention has been described with respect to a preferred embodiment, it is apparent that various changes can be made without departing from the spirit and scope of the invention as defined by the appended claims.

What is claimed is:

1. A dual air threading nozzle apparatus for urging a paper web away from the doctor blade disposed adjacent a dryer roll and in close conformance to the felt on a vacuum transfer roll of a single tier dryer section comprising:

a housing secured to said single tier section adjacent said doctor blade;

first air nozzle means disposed in said housing and operative to emit a first plane of air from said housing in a direction to urge the paper web away from the doctor blade; and second air nozzle means disposed in said housing and operative to emit a second plane of air from said housing in a direction to urge said paper web toward and in close conformance to the felt on said vacuum transfer roll.

2. A dual air threading nozzle apparatus for urging the tail of a paper web away from the doctor blade disposed adjacent a dryer roll and in close conformance to the felt on a vacuum transfer roll of a single tier dryer section as in claim 1 wherein said housing is elongated and is hemi-spherical in cross-section.

3. A dual air threading nozzle apparatus for urging the tail of a paper web away from the doctor blade disposed adjacent a dryer roll and in close conformance to the felt on a vacuum transfer roll of a single tier dryer section as in claim 2, wherein the outlets of said first nozzle means and said second air nozzle means are flush with the external surface of said hemi-spherical housing in order to prevent fluttering of the paper web from engaging said first and second nozzle means.

4. A dual air threading nozzle apparatus for urging the tail of a paper web away from the doctor blade disposed adjacent a dryer roll and in close conformance to the felt on a vacuum transfer roll of a single tier dryer section as in claim 2, wherein said first nozzle means includes a first elongated supply pipe extending along the length of said hemi-spherical housing, and including a plurality of spaced, first nozzles extending perpendicular to said first pipe, with the distal end of each said first nozzle being flush with the external surface of said hemi-spherical housing.

5. A dual air threading nozzle apparatus for urging the tail of a paper web away from the doctor blade disposed adjacent a dryer roll and in close conformance to the felt on a vacuum transfer roll of a single tier dryer section as in claim 2, wherein second nozzle means includes a second pipe extending along the length of said hemi-spherical housing, and including a plurality of spaced, second nozzles disposed perpendicular to said second pipe, with the distal end of said second nozzles being flush with the external surface of said hemi-spherical housing.

6. A dual air threading nozzle apparatus for urging the tail of a paper web away from the doctor blade disposed adjacent a dryer roll and in close conformance to the felt on a vacuum transfer roll of a single tier dryer section as in claim 1, wherein said first plane of air is at an angle to said second plane of air.

7. A dual air threading nozzle apparatus for urging the tail of a paper web away from the doctor blade disposed adjacent a dryer roll and in close conformance to the felt on a vacuum transfer roll of a single tier dryer section as in claim 6, wherein the angle between said first and second planes of air is in the range of 45°–90°.

8. A dual air threading nozzle apparatus for urging a paper web away from the doctor blade disposed adjacent a dryer roll and in close conformance to the felt on a vacuum transfer roll of a single tier dryer section comprising:

An elongated, hemi-spherical housing secured to said single tier dryer section adjacent said doctor blade;

a first nozzle means disposed in said hemi-spherical housing and operative to emit a first plane of air from said hemi-spherical housing in a direction to urge the paper web away from the doctor blade, said first nozzle means including a first elongated supply pipe extending along the length of said hemi-spherical housing, and including a plurality of spaced, first nozzles extending perpendicular to said first pipe;

second air nozzle means disposed in said hemi-spherical housing and operative to emit a second plane of air from said hemi-spherical housing in a direction to urge said paper web toward and in close conformance to the felt on said vacuum roll, said second nozzle means including a second pipe extending along the length of said hemi-spherical housing, and including a plurality of spaced, second nozzles disposed perpendicular to said second pipe; and wherein said first plane of air is at an angle to said second plane of air.

9. A dual air threading nozzle threading apparatus for urging a paper web away from the doctor blade disposed adjacent a dryer roll and in close conformance to the felt on a vacuum transfer roll of a single tier dryer section as in claim 8 wherein the distal ends of said first nozzles and the distal ends of said second nozzles are flush with the external surface of said hemi-spherical housing in order to prevent fluttering of the paper web from engaging the distal ends of said first and second nozzles.

10. A dual air threading nozzle threading apparatus for urging a paper web away from the doctor blade disposed adjacent a dryer roll and in close conformance to the felt on a vacuum transfer roll of a single tier dryer section as in claim 8 wherein the angle between said first and second planes of air is in the range of 45°–90°.

11. In a process for drying a paper web in a single tier dryer wherein the paper web is passed around a plurality of dryer rolls for drying the web, as well as said web being passed around a plurality of vacuum rolls, with each said vacuum roll of the plurality of vacuum rolls being disposed above and interposed between adjacent dryer rolls for conveying the web in a serpentine path by a dryer felt which is looped over the plurality of dryer rolls, and with the paper web between the felt and the dryer rolls, and with the felt further being looped around the plurality of vacuum rolls, the vacuum rolls being spaced in close proximity to their adjacent corresponding dryer rolls such that each of the plurality of vacuum rolls urges the web to closely conform to the felt while traversing said vacuum roll, and wherein the surface of each dryer roll is cleaned by a plurality of doctor blades disposed closely adjacent each said dryer rolls, the improvement comprising the steps of providing a first and a second plane of air, said first and second planes of air being in angular relationship to each other, with the first plane of air impinging on the tail of said paper web to urge said paper web away from said doctor blade, and wherein said second plane of air impinges on said paper web to urge said paper web over and in close conformance to said vacuum roll.

* * * * *